United States Patent [19]

Jensen

[11] Patent Number: 4,767,391

[45] **Date of Patent: * Aug. 30, 1988**

[54] APPARATUS FOR THE MANUFACTURE OF BLOCK-SEALED SIDE-GUSSETTED BAGS

[76] Inventor: Harold A. Jensen, 31 Annadea Rd., Brockton, Mass. 02402

[ * ] Notice: The portion of the term of this patent subsequent to Dec. 17, 2002 has been disclaimed.

[21] Appl. No.: 942,605

[22] Filed: Dec. 17, 1986

Related U.S. Application Data

[63] Continuation-in-part of Ser. No. 879,899, Jun. 30, 1986.

[51] Int. Cl.[4] ..... B31B 23/80; B31B 27/24

[52] U.S. Cl. ..... 493/196; 493/204; 493/256; 493/923; 425/290; 425/302.1

[58] Field of Search ..... 493/8, 193, 194, 195, 493/196, 197, 204, 256, 313, 923; 425/290, 302.1

[56] References Cited

U.S. PATENT DOCUMENTS

| | | | |
|---|---|---|---|
| 3,214,312 | 10/1965 | Gattrugeri | 493/195 |
| 3,446,121 | 5/1969 | Achelpohl | 493/313 |
| 3,988,970 | 11/1976 | Hanson et al. | 493/256 |
| 4,342,564 | 8/1982 | Lehmacher | 493/195 |
| 4,559,199 | 12/1985 | Jensen | 264/511 |

*Primary Examiner*—Robert P. Olszewski
*Assistant Examiner*—William E. Terrell
*Attorney, Agent, or Firm*—Samuels, Gauthier, Stevens & Kehoe

[57] ABSTRACT

Bags are manufactured from a tubular web of thermoplastic film. An air injector periodically inflates the film whereupon it contacts cooperating vacuum plates. One of the plates has a cutting die which cuts a tab in the film which in turn provides an ingress for the injected air. The film is then sealed and severed to form the bags, which are then formed into a block. The tab then serves as an opening to facilitate the removal of individual bags from the block.

2 Claims, 3 Drawing Sheets

FIG. 1
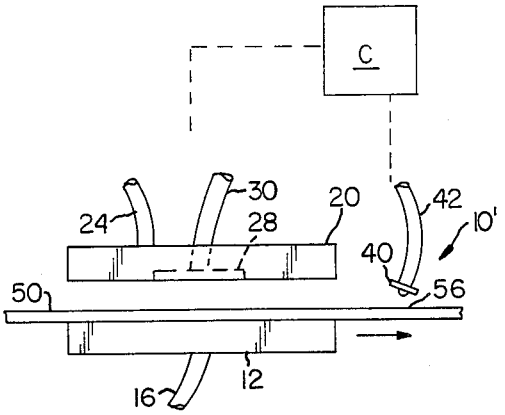
FIG. 2
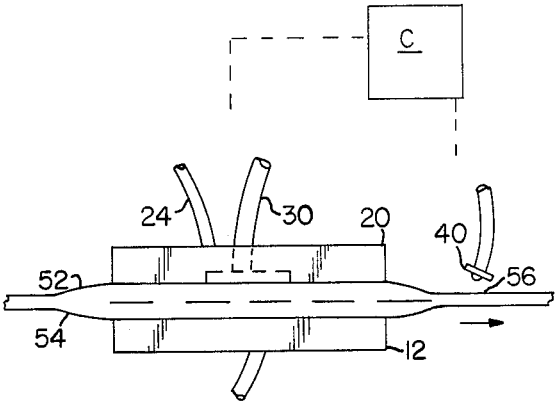
FIG. 6
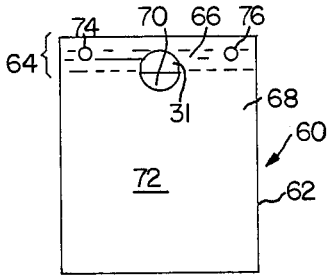
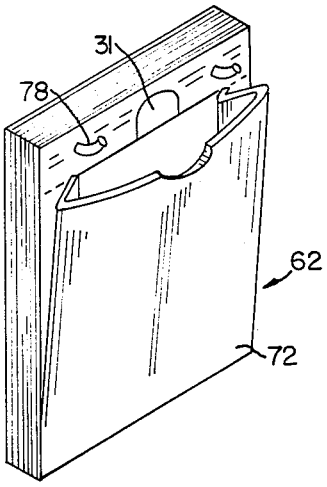
FIG. 7A
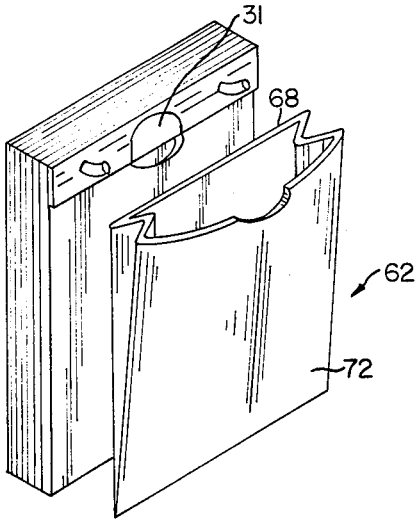
FIG. 7B

APPARATUS FOR THE MANUFACTURE OF BLOCK-SEALED SIDE-GUSSETTED BAGS

This is a continuation-in-part of application Ser. No. 879,899, filed June 30, 1986.

BACKGROUND AND BRIEF SUMMARY OF THE INVENTION

This invention relates to the field of flexible packaging and more particularly to a bundle of block-sealed, side-gussetted bags, each bag having an aperature formed in one side thereof and to the method of forming such bags.

In flexible packaging there are different types of bags formed. There are side weld bags formed by joining ribbon-like films together and sealing the seams. There are bottom weld bags formed by extruding a tubular film and forming a seam along the bottom of the bag. In bottom weld bags the film in flat two-ply form is sealed along one line at a first location to form the bottom of one bag; and perforated or cut along a second line parallel to the first line, to form the top of the next bag.

These bags whether formed as bottom-weld, side-gussetted bags or side-weld bags, are for some uses stacked and block sealed. Anywhere from twenty-five (25) to fifty (50) bags may be stacked and sealed at the same time or the bags may be stacked and sealed sequentially to form a bundle of block sealed bags. That is, the bags are sealed one to the other along an edge, usually the upper edge. Below this sealed upper edge are the perforated lines which allows an individual bag to be removed from the bundle. Generally the seal will be from a fraction of an inch to an inch or more in width. One or more holes may be punched through the block seal in order that the bags may be carried by a dispenser.

When a bag is removed from a block it has a tendency to cling to the bag it contacts such that the removal of one bag from another is hindered. In some uses of such bags, such as in deli counters, checkout registers etc. there is time wasted in separating the bags and subsequently opening the bags which results in frustration and on occasion the bags are discarded because they do not open easily.

It is believed the closest prior art in this field is that cited in my U.S. Pat. No. 4,559,199 which patent is incorporated by reference in its entirety into this disclosure and my copending application Ser. No. 879,899 filed June 30, 1986.

If such bags could be formed with an opening on one side of the bag only, then the problems attendant to opening and then removing such bags from the bundle would be overcome. For example if a crescent shaped opening were formed in one side at the top of each bag, then simply by passing a finger through the opening, grabbing a side and pulling outwardly, a user of the bags would necessarily apply tension to the bag and it would separate from the other bags to which it is joined at the perforated line as well as separate one side of the bag from the other; i.e. open the bag. There are presently available block-sealed, side-weld bags where one side of the bag is shorter than the other. This shorter side generally faces outwardly and the upper edge may be grasped whereby the bag may be removed from the block. Typically this upper edge is formed as a lip. It would be desirable if a side-gussetted bag had this feature, that is, an opening on one side of the bag only, it being well understood that side-gussetted bags pack more easily and are more voluminous than a corresponding dimensioned side-weld bag.

The present invention is in one aspect an improvement of the method of making the side-gussetted, bottom-weld bags such as described in my aforementioned patent or side-gussetted angular gussett bottom-seal bags (square bottom). One side of each of said bags has an opening formed therein. The use of the term "opening" as used in this disclosure is intended to mean an opening in one ply of the bag such as a circle, square, ellipse or the like formed below the upper edge of the side, or that the opening intersects the upper edge of one side of the bag and/or the opening extends from one side to the other side of the bag.

My invention, in another aspect, embodies the block-sealed, side-gussetted bags of my aforementioned application with square bottoms.

BRIEF DESCRIPTION OF THE DRAWINGS

FIG. 1 is a side schematic view of a device for forming openings;

FIG. 2 is a side schematic view of FIG. 1 wherein a film has been inflated;

FIG. 6 is a front view of a bundle of block-sealed bags of the preferred embodiment;

FIGS. *7a* and *7b* are perspective views of a bag being removed from a bundle of block-sealed bags.

DESCRIPTION OF THE PREFERRED EMOBIDMENT(S)

The invention will be described in reference to block-sealed, side-gussetted, bottom-weld bags. The techniques for forming these bags per se from continuous film are well known in the art and need not be described in detail.

As disclosed in my aforementioned patent, upsteam of the station where the bags are sealed and cut to size, vacuum plates in spaced apart relationship are secured above and below the travelling film. Preferably the film travels on or is adjacent to the bottom vacuum plate.

Figure 3:
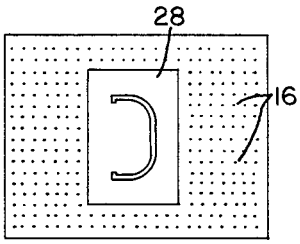
FIG. 3 is a bottom view of a die of the preferred embodiment.

Referring to FIGS. 1, 2 and 3 an apparatus is shown generally at 10 and comprises a bottom vacuum plate 12 having a plurality of perforations 14 (not shown) therein. A vacuum line 16 creates the vacuum within the plate.

Above vacuum plate 12 is a vacuum plate 20 having plurality of perforations 16 and a vacuum line 24 to create the vacuum in the plate 20. Additionally, recessed in the plate 22 is a dieholder 28 to which is secured a die 26. The dieholder 28 is a solid rectangular ceramic block. The die 26 which determines the shape of the section formed, extends from the block; and is connected to two leads (not shown) which in turn are connected to a suitable source of current. Downstream of the vacuum plates is a nozzle 40 joined to a compressed air line 42. Passing between the plates is a side-gussetted, two-ply film 50 comprising plies 52 and 54 and an opening 56, shown most clearly in FIG. 5.

Figure 5:
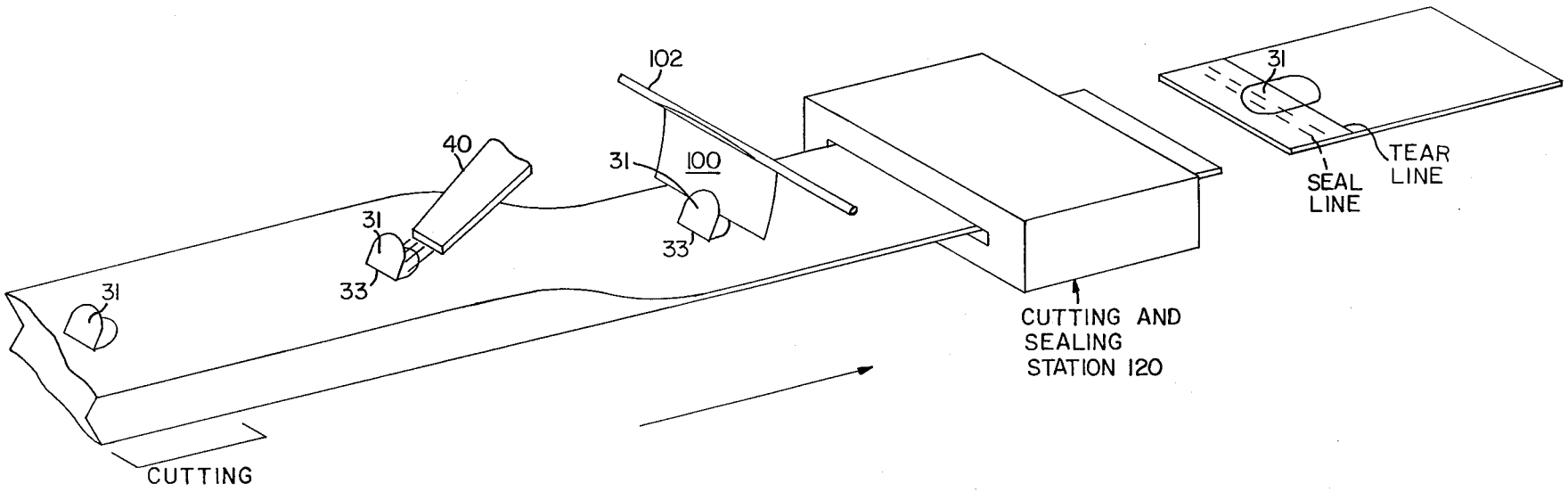
FIG. 5 is a perspective view of the film without the upper vacuum plate.

The preferred embodiment will be described in regard to the following as a non-limiting example. High density polyethylene film, two-ply, one mil thick formed as a continuous tube is flattened and passes through the vacuum plates 12 and 20. Initially, a cut shown at 56 is made manually in the upper ply, when the cut reaches the nozzle 42 the film expands or billows as shown in FIGS. 2 and 5. The vacuum on vacuum plate 20 is between 22–25 inches. The vacuum on vacuum plate 12 is about 10 inches. These vacuums are preferably applied continuously. When the film billows it contacts the die 26 and the vacuum then applied to line 30 is approximately 29 inches. The ply of film which contacts the die is cut by the die. The die is a hot wire, in this embodiment a discontinuous perimeter, which defines the geometry of the section of blank to be cut. The section is cut as a tab 31 which is not physically removed (as was the case in the preferred embodiment of my patent). It has been found more efficient to fold the tab at a hinge line 33 and retain the tab with the film.

After the cut has been made, the increased vacuum in line 30 ceases. The film moves in the direction of the arrow. The top ply with the tab-opening settles and the film resumes its travel until the tab-opening just formed is contacted by the air jet from line 42. The film inflates and the cutting operation is performed. These steps continue in timed sequence by virtue of a control means schematically shown at C.

Referring to FIG. 5 the steps are illustrated with the vacuum plates deleted for clarity.

The air from nozzle 40 almost always causes the tab 31 to lift upwardly from the ply 52 as shown in FIG. 5. Occasionally, the tab will partially fold under the ply. However, as the film travels toward the station 120 where the film will be formed into bags, it is first contacted by a free hanging strip 100, such as foamed urethane, which depends from a frame 102. The strip engages the tab 31. The adhesive characteristics of the strip versus the film properties is such that as the film continues its travel the tab will be engaged and folded rewardly even if the tab is originally folded partially under. When the film passes into the station, the tab is sealed along the seal line. More specifically, at cutting and sealing station 120, the continuous film is sealed and cut along a first line to seal the bottom of one bag and separate the one bag from the film while forming a seal line across the top of the next bag to be formed this seal line spaced apart from the leading edges of such next bag to be formed while also forming a perforated line (tear line) across the film and upstream (above) the seal line. The single bag of FIG. 5 shows the tab sealed on the seal line.

Figure 4:
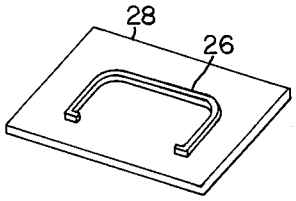
FIG. 4 is a perspective view of the die of FIG. 3.

In a working example the plates 12 and 20 were approximately 5 inches by 6 inches with a depth of 1 inch and a spatial separation between the facing portions of the plates of approximately a ½ inch. Formed into plate 12 was a chamber approximately 2 inches by 3 inches into which was secured the holder 28 having the die 26 received therein. The die is shown most clearly in FIG. 4. The vacuum created in the dieholder chamber is independent of that created in the vacuum plate 20. The perforations in each of the plates were 1/16 inch diameter holes based on 1 inch spacing. The die (wire) was nickel-chromium wire 0.0035 inch thick, and ⅛ inch wide. A current of 13 to 15 amps at 4 to 4½ volts was applied. The dieholder was asbestos glass, marinite. The flow of air through the airline 42 was at approximately 60 psig through a ¼ inch tubular opening.

Depending upon the specific film, the size of the cut and other operating conditions the process can be run continuously or continually; that is, in the latter instance the film can be stopped for a fraction of a second after inflating to allow for the cutting and removal of the blank.

Subsequently, the bags are formed and stacked, one on top of the other, with the upper edges aligned, at anywhere between twenty-five (25) to fifty (50) bags in a bundle. The number of bags to be stacked will depend upon the type of block seal made, the film thickness and the ultimate use of the block-sealed bundle.

As shown in FIG. 6 the bags are typically block-sealed in bundles and when necessary for use a bag is removed from the bundle. With the invention by inserting a finger or other device into the opening the bag can be both removed from the bundle with ease and also the bag itself opened with ease.

FIG. 6 shows a bundle 60 of bags 62 having upper portions 64 which are block-sealed at 66. Release lines are formed by perforated lines 68 below the seal 66. Each of the bags 62 has an opening 70 formed in a first outer side 72. The second facing side 74 does not have an opening in register with the opening 70. Holes 76 are formed in the seal 66 whereby the bundle may be held by a dispenser 78.

FIG. **7*a* illustrates the bag 62 being opened and FIG. 7*b* illustrates the bag 62 after removal. When the bag is grasped typically a finger passes through the opening 70 and strikes the second side 74. The grasping and moving of the first side 72 both opens the bag and removes the bag from the bundle at the perforated line 68**. The tabs remain with the sealed positions and do not interefere with the removal of the bags.

Figure 8:
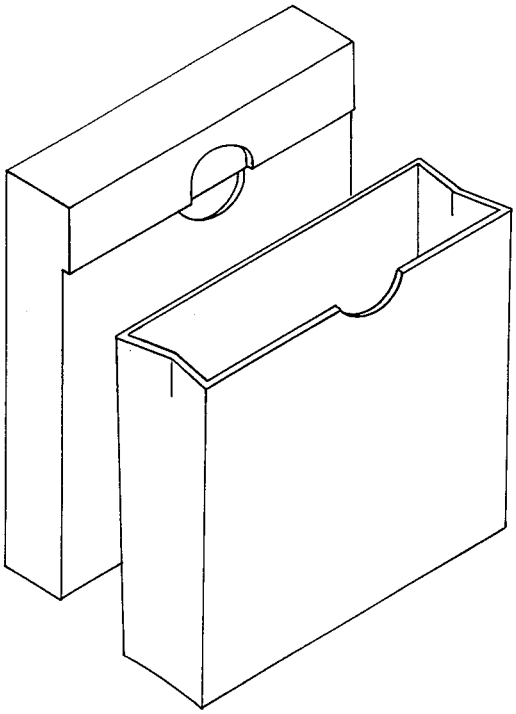
FIG. 8 is a perspective view of a side-gussetted, square bottom bag.

FIG. 8 illustrates square bottom, block-sealed bags formed in accordance with the teachings of the invention.

The invention has been described in reference to the cutting of a tab from one side of a two-ply tubular film. Obviously different geometric shapes of blanks cut. Also if desired the portion to be removed could be simply perforated such as by using a serrated die and the blank removed later. Additionally different blanks could be removed from both sides of the two-ply film; that is, dies could be placed within both vacuum plates and either vacuum plate may contain one or more dies. The film used in the invention could be any film such as is currently experienced in flexible film packaging such as any of the polyethylenes etc. Further other materials of constructions can be used for the dye.

Having described my invention, what I now claim is:

1. An apparatus for forming a sectioning operation on a continuous tubular film for forming bags which comprises:

a first vacuum plate having a die for cutting a tab in the film secured thereto;

a second vacuum plate spaced apart from the first vacuum plate to define a passage there between through which the film travels;

airstream means downstream of the vacuum plates to introduce an airstream into the continuous tubular film to billow the same; means to control the vacuum plates and the airstream means whereby when the film is billowed it contacts and is temporarily held by the first and second vacuum plates and the portion of the film contacting the die is cut by the die to form a tab in the film and subsequent to the cutting the introduction of air is ceased; and means to seal the film from one edge to the other along a first seal line and to cut the film from one edge to the other along a second line spaced apart from the first line to form a bag.

2. The apparatus of claim 1 which further comprises:

means to engage the tab and fold the tab in a rearedly direction such that it overlies the first seal line when the seal is formed.

* * * * *